US010667662B2

(12) United States Patent
Carswell et al.

(10) Patent No.: US 10,667,662 B2
(45) Date of Patent: Jun. 2, 2020

(54) CLEANER HEAD

(71) Applicant: Dyson Technology Limited, Wiltshire (GB)

(72) Inventors: James Robert Carswell, Bristol (GB); Donald James McIntosh, Gloucester (GB); Vid Stiglic, Gloucester (GB); Charles Franklin Gale, Bristol (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 195 days.

(21) Appl. No.: 15/982,183

(22) Filed: May 17, 2018

(65) Prior Publication Data

US 2018/0333028 A1 Nov. 22, 2018

(30) Foreign Application Priority Data

May 18, 2017 (GB) ..... 1707990.6

(51) Int. Cl.
*A47L 9/04* (2006.01)
*A47L 9/06* (2006.01)

(52) U.S. Cl.
CPC ..... *A47L 9/0477* (2013.01); *A47L 9/04* (2013.01); *A47L 9/0455* (2013.01); *A47L 9/06* (2013.01); *A47L 9/0606* (2013.01)

(58) Field of Classification Search
CPC ..... A47L 9/0477; A47L 9/04; A47L 9/0606; A47L 9/06; A47L 9/0455; A47L 9/00; A47L 9/02; A47L 11/40; A47L 13/20
USPC ..... 15/383
See application file for complete search history.

(56) References Cited

U.S. PATENT DOCUMENTS

| | | | |
|---|---|---|---|
| 2006/0064828 | A1 | 3/2006 | Stein et al. |
| 2010/0218339 | A1 | 9/2010 | Fahlstrom |
| 2011/0047746 | A1 | 3/2011 | Butts et al. |
| 2014/0066278 | A1 | 3/2014 | Stein et al. |
| 2015/0313434 | A1 | 11/2015 | Ruffo |
| 2016/0220081 | A1 | 8/2016 | Xu et al. |

FOREIGN PATENT DOCUMENTS

| | | |
|---|---|---|
| CN | 203226776 | 10/2013 |
| CN | 104887151 | 9/2015 |
| DE | 102012020832 | 4/2013 |
| JP | 2008-383 | 1/2008 |

(Continued)

OTHER PUBLICATIONS

Search Report dated Oct. 2, 2017, directed to GB Application No. 1707990.6; 1 page.

(Continued)

*Primary Examiner* — David Redding
(74) *Attorney, Agent, or Firm* — Morrison & Foerster LLP

(57) ABSTRACT

A cleaner head includes an agitator; a housing defining an agitator chamber and an aperture through which the agitator can be removed from the agitator chamber; and an end cap attachable to the housing to close the aperture, and releasable from the housing to open the aperture. The end cap is attachable and releasable by rotating at least a locking portion of the end cap about a locking axis between locked and unlocked positions relative to the housing. The cleaner head has a latch mechanism configured to prevent rotation of the locking portion to the unlocked position. The latch mechanism has a release member which is provided on the end cap, the release member being operable by hand to release the latch.

18 Claims, 9 Drawing Sheets

(56) References Cited

FOREIGN PATENT DOCUMENTS

| | | |
|---|---|---|
| JP | 5429374 | 2/2014 |
| WO | 2015/118981 | 8/2015 |

OTHER PUBLICATIONS

International Search Report and Written Opinion dated Aug. 8, 2018, directed to International Application No. PCT/GB2018/051168; 13 pages.

CLEANER HEAD

REFERENCE TO RELATED APPLICATIONS

This application claims the priority of United Kingdom Application No. 1707990.6, filed May 18, 2017, the entire contents of which are incorporated herein by reference.

FIELD OF THE INVENTION

The present invention relates to a cleaner head, for instance of the type that may be used on a vacuum cleaner. More specifically, the invention relates to cleaner heads that incorporate agitators, such as rotatable brush bars which are used in vacuum cleaners to agitate a surface being cleaned so as to loosen dirt so as to improve cleaning performance.

BACKGROUND OF THE INVENTION

Some cleaner heads are provided with an aperture through which the agitator can be removed from the cleaner head, for instance to clean the agitator, with the aperture being closed using an end cap during normal use. However, in some arrangements removing the end cap requires use of a tool. This requires the user to locate that tool before they can remove the cap, adding complexity and time to the process of removing the agitator. In other arrangements, the cap can be released by operating a mechanism on a housing of the cleaner head. However, to remove the end cap the user is required to hold the cap in one hand and hold the housing with the other, and then stretch fingers from one of those hands to operate the mechanism. This can be fiddly and time consuming, and difficult for those with reduced dexterity.

SUMMARY OF THE INVENTION

It is one object of the present invention to mitigate or obviate at least one of the above disadvantages, and/or to provide an improved or alternative cleaner head or vacuum cleaner.

According to a first aspect of the present invention, there is provided a cleaner head comprising: an agitator; a housing defining an agitator chamber and an aperture through which the agitator can be removed from the agitator chamber; and an end cap attachable to the housing to close the aperture, and releasable from the housing to open the aperture, wherein the end cap is attachable and releasable by rotating at least a locking portion of the end cap about a locking axis between locked and unlocked positions relative to the housing; the cleaner head has a latch mechanism configured to prevent rotation of the locking portion to the unlocked position; and the latch mechanism has a release member which is provided on the end cap, the release member being operable by hand to release the latch mechanism so as to allow the locking portion to rotate to the unlocked position.

According to some embodiments, the present invention may provide a cleaner head where the end cap can be removed to open the aperture with advantageous ease. As one example, a release member that is operable by hand may avoid the user needing to purchase or locate a tool before they are able to remove the end cap. As another example, the release member being provided on the end cap may position it in easier reach for a user in comparison to an arrangement where a release member is provided on the housing.

The release member being 'operable by hand' is intended to mean that the release member can be operated by a user without the assistance of a tool. For example, a user may push or pull the release member with a finger or fingernail, or squeeze two parts of the release member between finger and thumb.

The locking portion may be rotationally fixed on the end cap, the locking portion being rotatable about the locking axis by rotating the entire end cap about the locking axis.

The locking portion being rotationally fixed on the end cap may allow the end cap to be of advantageously simple design in comparison to arrangements where the locking portion is rotatable relative to other parts of the end cap. The locking portion being rotatable about the locking axis by rotating the entire end cap may provide an advantageously simple and easily understood mechanism for the user, since the user can merely grasp the end cap and rotate it, rather than having to rotate a particular part of the end cap.

As one alternative, the locking portion may be provided on a collar which is rotatable relative to the remainder of the end cap.

The end cap may be arranged such that operation of the release member produces a moment which urges the locking portion to rotate towards the unlocked position.

This has the advantage that at least some of the effort the user exerts to operate the release member assists with rotation of the locking portion towards the unlocked position. Accordingly, less extra effort (if any) must be applied by the user to rotate the locking portion.

Although this functionality is considered to be preferable, the present invention may nonetheless be utilized in arrangements where operating the release member does not urge the locking portion to rotate at all, or even arrangements where operating the release member urges the locking portion away from the unlocked position.

The locking portion may be movable to the locked position by rotating it about the locking axis in a first direction, and be movable to the unlocked position by rotating it about the locking axis in a second direction which is opposite to the first direction.

This arrangement may be advantageously intuitive to the user, and/or may allow an advantageously simple attachment mechanism to be utilized.

As an alternative, or in addition, the locking portion may be movable to the locked position by rotating it in a first direction, but be movable to the unlocked position by moving it further in the same direction.

The release member may comprise a push-button. This may make operation of the release member an advantageously simple and/or intuitive action for the user.

Alternatively or in addition, the release member may comprise a lever which is operable by the user lifting it, or a knob which is operable by the user turning it.

Optionally, the latch mechanism comprises a tooth provided on the locking portion and a complementary tooth provided on the housing; the teeth are arranged to cam over one another when the locking portion is rotated to the locked position, and abut to prevent rotation of the locking portion to the unlocked position; and operation of the release member moves the teeth out of alignment so that they cannot abut one another and the locking portion can be rotated to the unlocked position.

The latch mechanism may therefore function in a manner akin to a ratchet, a mechanism that may be advantageously easily understood by a user and/or simple to manufacture.

As one alternative, the latch mechanism may comprise a keyhole-shaped opening provided on the housing and a key-shaped rotatable projection provided on the locking portion. The projection may be received within the opening when the locking portion is in the locked position, whereupon the projection may be rotated (by hand) so that it cannot be withdrawn from the opening and therefore the locking portion cannot be rotated to the unlocked position, and rotated back into alignment with the opening when the user wishes to release the latch mechanism so that locking portion can be moved to the unlocked position.

Where the latch mechanism comprises said teeth the release member may be a rocker which comprises the tooth of the locking portion; and the rocker may be pivotable to allow said tooth to be cammed over the tooth of the housing when the locking portion is rotated to the locked position, and to allow said tooth to be lifted out of alignment with the tooth of the housing when the release member is operated.

This may provide a mechanism which is advantageously intuitive to operate and/or cheap to manufacture.

As one alternative, the release member may be rotationally fixed, and be movable out of alignment with the tooth of the hosing by displacing it laterally.

The agitator chamber may be configured to rotatably support the agitator.

The agitator being rotatable in the agitator chamber may allow it to perform a more thorough agitating action (for instance if the agitator is actively driven by an electric motor, a turbine or the like). Instead or as well, it may reduce the risk of the agitator marking a surface (for instance if the agitator is passively rotatable so that it 'freewheels' and can roll over a surface).

The agitator chamber may be configured to support the agitator to rotate about an axis which is substantially parallel to, and preferably substantially collinear with, the locking axis.

Alternatively, the agitator chamber may fixedly support the agitator (for instance where the agitator is a generally planar scraper or bristle array).

Where the agitator chamber is configured to rotatably support the agitator, the end cap may have a bearing assembly positioned to support an end of the agitator when the agitator is positioned within the agitator chamber.

This may provide an advantageously simple way of supporting the agitator for rotation, while still allowing the agitator to be removable from the agitator chamber through the aperture.

As an alternative, the agitator may be supported on each end by bearing assemblies provided separately from the end cap. For instance, the agitator may be supported on one end by a bearing assembly that is fixed to the agitator chamber, and on the other end by a bearing assembly which is removable from the agitator chamber but which is not part of the end cap.

The end cap may be attachable to the agitator such that removing the end cap from the housing also removes the agitator from the agitator chamber.

This may improve the ease with which a user can remove the agitator from the agitator chamber—they need simply remove the end cap from the housing and the agitator will be removed with it.

Preferably, the end cap and agitator are releasably attachable to one another. This would allow the end cap and agitator to be separated when desired, for instance to clean or replace the agitator without needing to do the same to the end cap. Where the end cap and agitator are releasably attachable to one another, they may be attachable by an interference fit. This may allow the user to quickly and easily separate the end cap and brush bar simply by pulling them apart.

As an alternative, the end cap and agitator may not be attached to one another, at which point the user could remove the end cap and then reach into the agitator chamber to pull out the agitator.

The end cap and housing may be shaped to co-operatively provide a substantially contiguous outer surface of the cleaner head when the locking portion is in the locked position.

This may allow the outer surface of the cleaner head to have relatively few sharp changes in geometry which could collect dirt or snag on furniture.

As an alternative, the end cap and housing may be shaped to provide a change in geometry at the boundary therebetween. This may allow the user to easily identify where the end cap and housing meet (for instance if they are required to rotate the entire end cap relative to the housing).

The release member may be positioned on a part of the end cap which forms part of a front, rear, side or top surface of the cleaner head.

With the release member positioned in this way, it may be less susceptible to its operation being obstructed by dirt or dust buildup than if it was positioned on a bottom surface of the cleaner head. The release member is preferably provided on a rear surface of the cleaner head. This may reduce the possibility of the release member being operated accidentally due to a knock (such as a collision between the cleaner head and an item of furniture).

As an alternative, the release member may be positioned on a bottom surface of the cleaner head. This may give the cleaner head a more uniform appearance in normal use (e.g. when the bottom surface is resting on a floor surface).

The locking portion may be attachable to the housing via one or more pairs of interlocking projections and recesses, said projections being received in corresponding recesses when the locking portion is in the locked position, and being positioned outside said recesses when the locking portion is in the unlocked position.

This may provide an attachment mechanism which is advantageously quick, simple or intuitive for a user to operate.

As an alternative, the locking portion may be attachable to the housing via mutually-engageable screw threads.

At least one of the locking portion and the housing may comprise one or more ramp surfaces positioned to translate rotation of the locking portion about the locking axis into axial movement of the locking portion along the locking axis, and/or to translate axial movement of the locking portion along the locking axis into rotation of the locking portion about the locking axis.

This can allow one type of movement of the locking portion to cause a complementary different type of movement of the locking portion, as explained in more detail later.

Where the locking portion is attachable to the housing via one or more pairs of interlocking projections and recesses, the projections and/or recesses may provide the ramp surfaces.

For the avoidance of doubt, reference above to movement of the locking portion along the locking axis is intended to require movement in a direction which has a component parallel to the locking axis. It is not intended to be limited to movement of the locking portion in a direction parallel to the locking axis.

At least one of said the ramp surfaces may be positioned to cam the locking portion towards the locked position when the locking portion is urged towards the housing, and/or to cam the locking portion away from the housing when the locking portion is rotated towards the unlocked position.

The ramp surface camming the locking portion towards the locked position when the locking portion is urged towards the housing may allow the process of rotating the locking portion to the locked position may be started by the user introducing the end cap to the housing. Alternatively or in addition, this camming action may mitigate the risk of the lugs contacting walls of the recesses and preventing the end cap from being fully presented to the housing.

The ramp surface camming the locking portion away from the housing when the locking portion is rotated towards the unlocked position may allow the process of removing the end cap from the housing to be accomplished partially by the user rotating the locking portion to the unlocked position.

At least one of the ramp surfaces may be positioned to cam the locking portion towards the housing when the locking portion is rotated towards the locked position, and/or to cam the locking portion towards the unlocked position when the locking portion is moved away from the housing.

The ramp surface camming the locking portion towards the housing when the locking portion is rotated to the locked position may allow moving the locking portion to the locked position to pull the end cap snug against the housing, which may provide improved sealing therebetween. Improved sealing can, for example, improve suction efficiency where the cleaner head is a vacuum cleaner.

The ramp surface camming the locking portion towards the unlocked position when the locking portion is moved away from the housing may allow the locking portion to finish unlocking itself if the user tries to pull the end cap away from the housing before the locking portion has reached the unlocked position.

The cleaner head may further comprise a biasing member which biases the locking portion from the locked position towards the unlocked position.

This may reduce the effort required from the user to unlock the locking portion. For instance, the biasing member may be arranged so that the user needs only to operate the release member so as to release the latch mechanism, whereupon the locking portion would move to the unlocked position under action of the biasing member.

In some embodiments, such as the example given above, the biasing member may be arranged to bias the locking portion all the way to the unlocked position. In other embodiments, however, the biasing member may only bias the locking portion part way to the unlocked position. In such embodiments the biasing member would assist with the unlocking of the locking portion, but would still require some degree of additional effort on the part of the user.

According to a second aspect of the present invention there is provided a vacuum cleaner comprising a cleaner head according to the first aspect of the invention.

This may provide a vacuum cleaner the cleaner head of which provides one or more of the advantages discussed above.

BRIEF DESCRIPTION OF THE DRAWINGS

Embodiments of the present invention will now be described, by way of example only with reference to the accompanying drawings in which.

Throughout the description and drawings, corresponding reference numerals denote corresponding features.

DETAILED DESCRIPTION OF THE INVENTION

Figure 1:
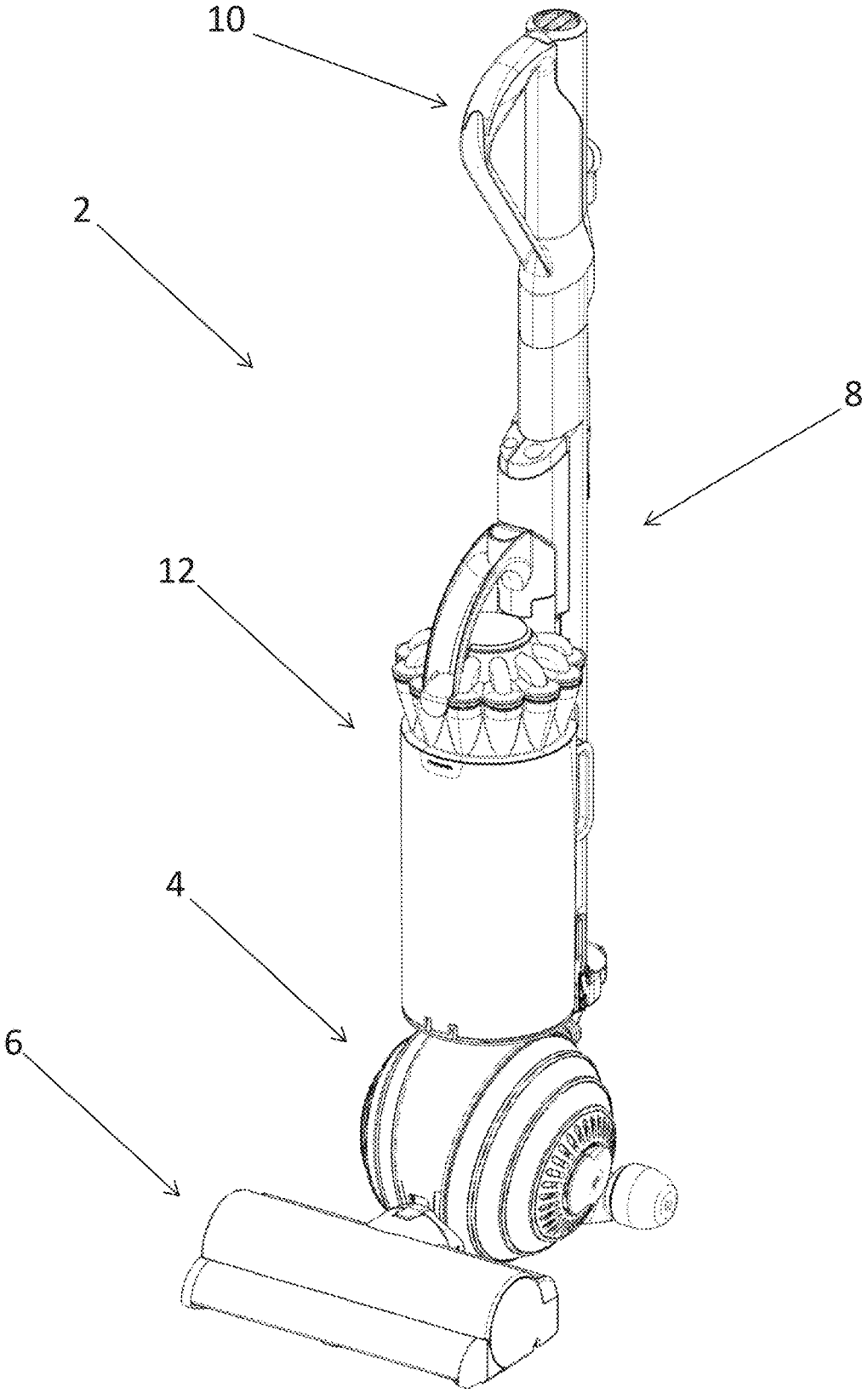
FIG. 1 is an upper front perspective view of a vacuum cleaner according to an embodiment of the invention.

FIG. 1 shows a vacuum cleaner 2 according to an embodiment of the invention. The vacuum cleaner 2 of this embodiment is an upright vacuum cleaner. It has a rolling assembly 4 which carries a cleaner head 6, and an 'upright' body 8. The upright body 8 can be reclined relative to the head assembly 4, and includes a handle 10 for manoeuvring the vacuum cleaner 2 across the floor. In use, a user grasps the handle 10 and reclines the upright body 8 until the handle 10 is disposed at a convenient height. The user can then roll the vacuum cleaner 2 across the floor using the handle 10 in order to pass the cleaner head 6 over the floor and pick up dust and other debris therefrom. The dust and debris is drawn into the cleaner head by a suction generator in the form of a motor-driven fan (not visible) housed on board the vacuum cleaner 2, and is ducted in conventional manner under the fan-generated suction pressure to a cyclonic separating apparatus 12 where dirt is separated from the air. The relatively clean air is then exhausted back to the atmosphere.

Figure 2:
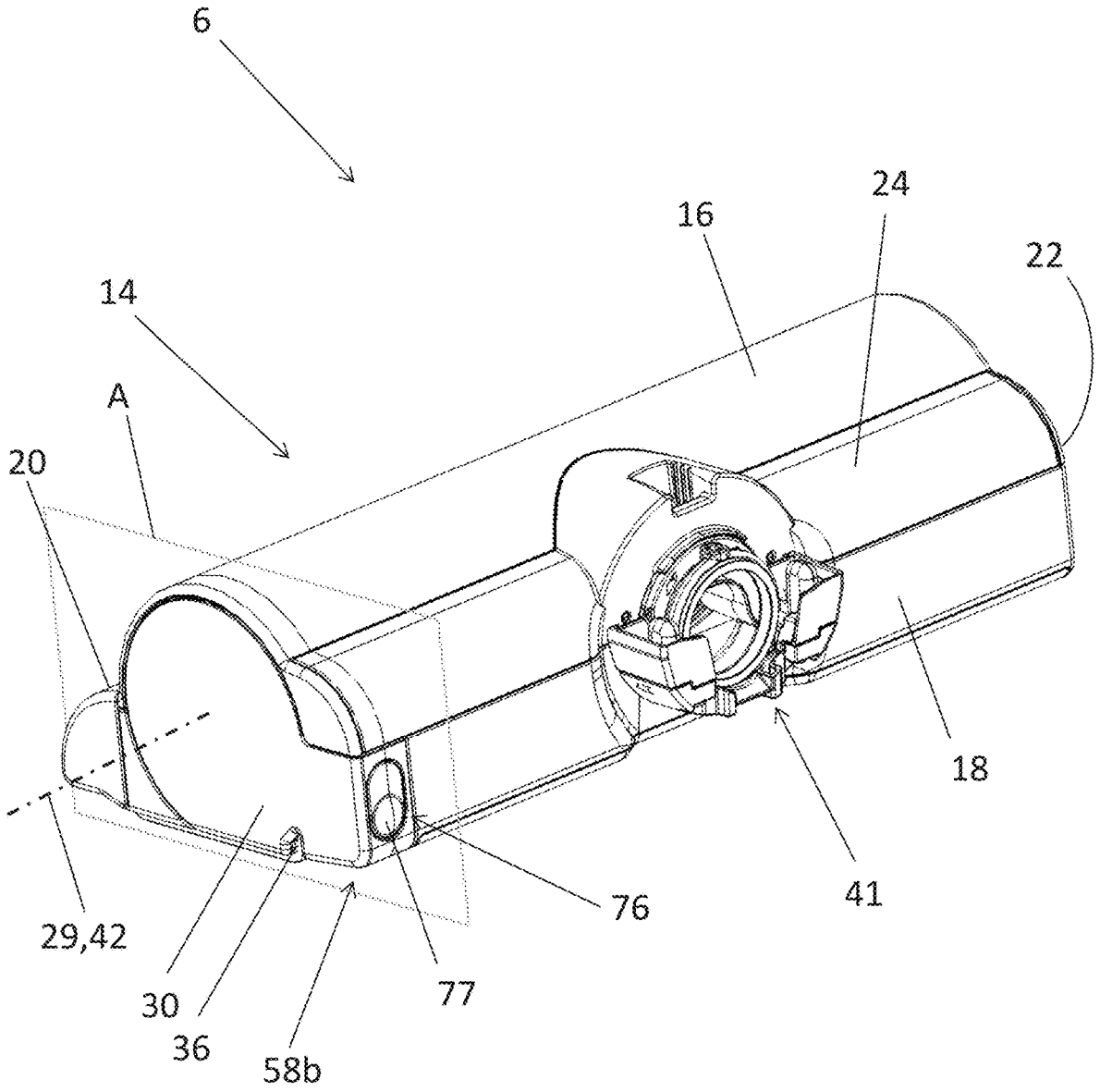
FIG. 2 is an upper rear perspective view of the cleaner head of the vacuum cleaner of FIG. 1.
Figure 3:
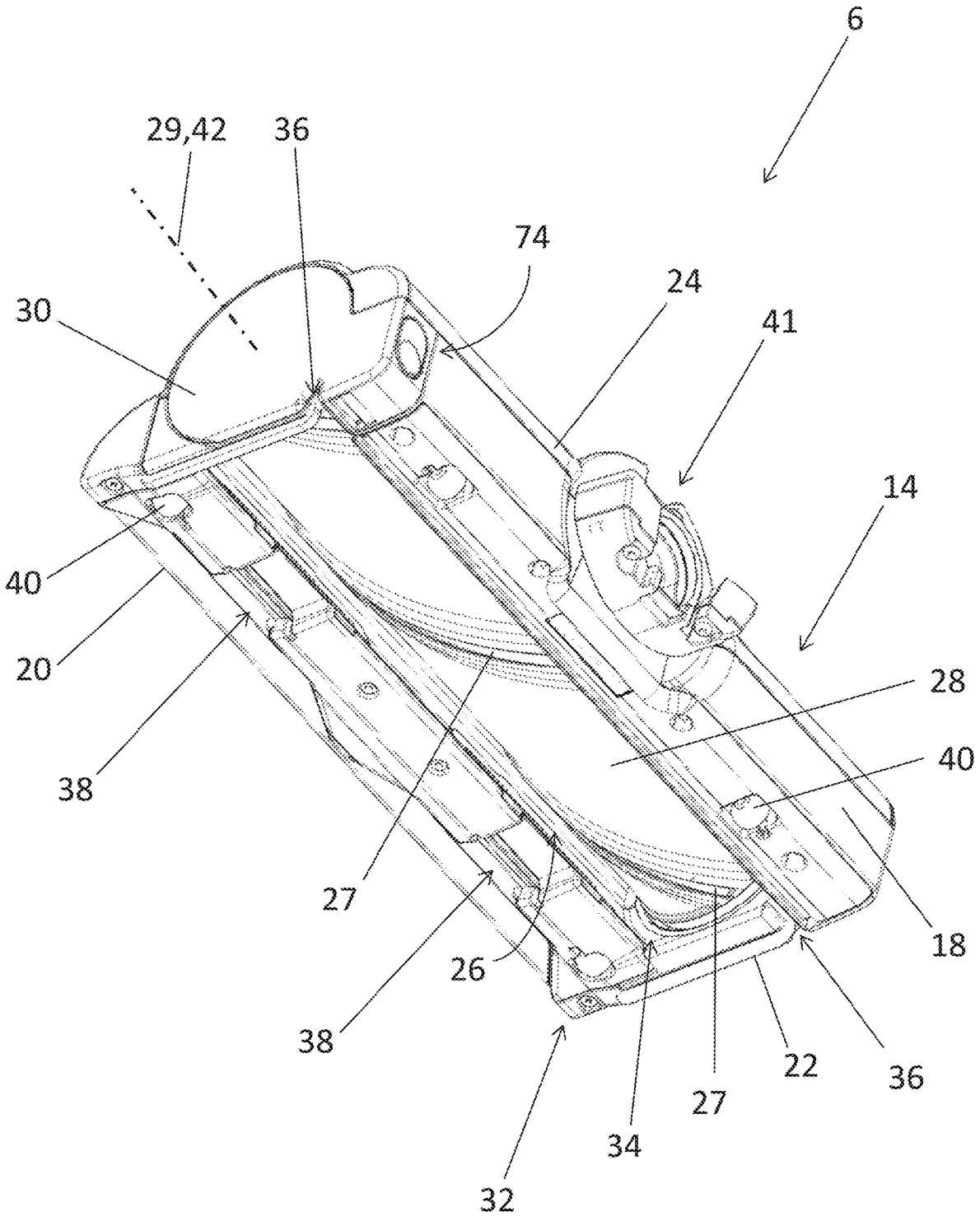
FIG. 3 is a lower rear perspective view of the cleaner head.

The cleaner head 6 is shown in isolation in FIGS. 2 and 3. It has a housing 14 made up of an upper housing 16, a lower housing 18, a front bumper 20, a side wall 22 and a rear housing 24. The housing 14 defines an agitator chamber 26 within which an agitator 28 is received. The agitator 28 of this embodiment is hollow and generally cylindrical, with helical grooves 27 configured to support arrays of agitating bristles (not shown). The agitator chamber 26 rotatably supports the agitator 28 so that the agitator can rotate about a rotation axis 29. In this case, the rotation axis 29 is also the longitudinal axis of the agitator. The agitator 28 can be driven to rotate by an electric motor (not visible) housed inside it.

The cleaner head 6 also has an end cap 30 which can be attached to the housing 14 or detached therefrom, so as to close or open an aperture (not visible) in the housing through which the agitator 28 can be inserted into or removed from the agitator chamber 26. With the cleaner head configured as shown in FIGS. 1 to 3, the end cap 30 and the housing 14 co-operatively define a substantially contiguous outer surface. In other words, there is no significant gap or abrupt change in geometry between the end cap 30 and the housing 14.

The lower housing 18 forms a sole plate 32 configured to pass over a surface to be cleaned. The sole plate 32 defines a suction opening 34, side bleeds 36 and front openings 38, and is provided with four downward-facing wheels 40. The rear housing 24 includes a n outlet duct 41. Referring to FIGS. 2 and 3 in conjunction with FIG. 1, the cleaner head 6 is connected to the rolling assembly 4 of the vacuum cleaner 2 by the outlet duct 41, which forms a flow path therebetween. In use, the user maneuvers the cleaner head 6 across a floor surface using the handle 10, as described above. Dust and debris is sucked into the agitator chamber 26 of the cleaner head 6 through the suction opening 34, the side bleeds 36 and the front openings 38. The dust and debris is then sucked out of the cleaner head 6 through the outlet duct 41.

In this embodiment, when the cleaner head 6 is resting on a hard surface such as a laminate floor, the cleaner head 6 is supported by the wheels 40. However, when the cleaner head 6 is resting on a carpet, the wheels 40 sink into the pile of the carpet and the suction opening 34 is therefore positioned further down. This allows carpet fibres to protrude through the suction opening 34, whereupon they are disturbed by the agitator 28 so as to loosen dirt and dust therefrom.

Figure 4:
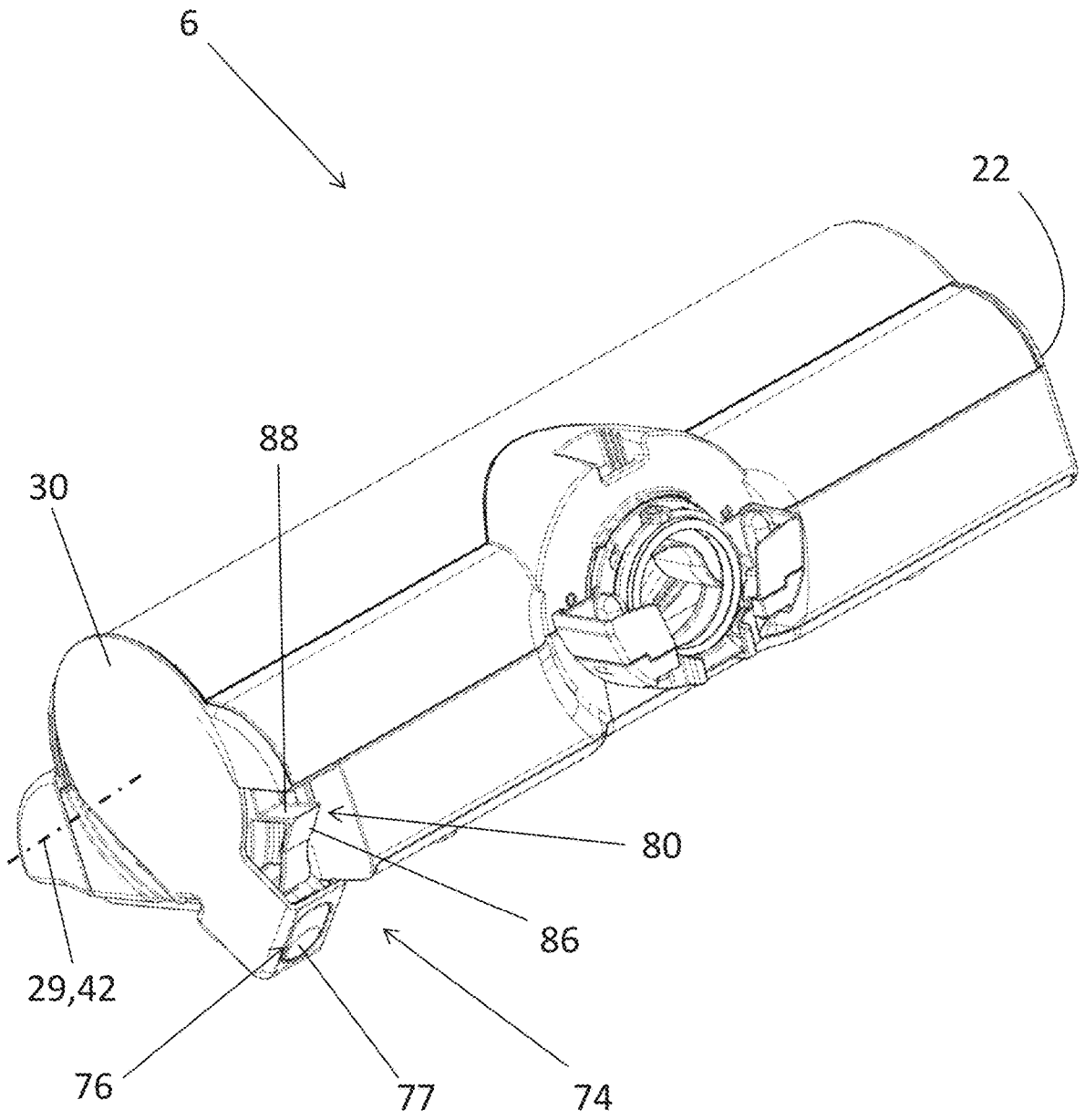
FIG. 4 is an upper rear perspective view of the cleaner head, with an end cap of the cleaner head in an unlocked position relative to a housing of the cleaner head.

As noted above, the end cap 30 is releasable from the housing 14. More particularly, the end cap 30 is releasable by rotating it relative to the housing 14 about a locking axis 42 to an unlocked position. Similarly, the end cap 30 can be (re-)attached to the housing 14 by rotating it about the locking axis 42 to a locked position relative to the housing. FIGS. 1-3 show the end cap 30 in the locked position and FIG. 4 shows the end cap 30 in the unlocked position. In this embodiment, the locking axis 42 is collinear to the rotational axis 29 of the agitator 28.

The mechanism by which the end cap is attachable to and releasable from the housing 14 will be described in more detail later. However, it is important to note that in this embodiment to move the end cap 30 to the unlocked position it is rotated about the locking axis 42 in one direction (i.e. clockwise from the perspective of FIGS. 1-4), and to move the end cap 30 to the locked position it is rotated relative about the locking axis 42 in the opposite direction (i.e. anticlockwise from the perspective of FIGS. 1-4).

Figure 5:
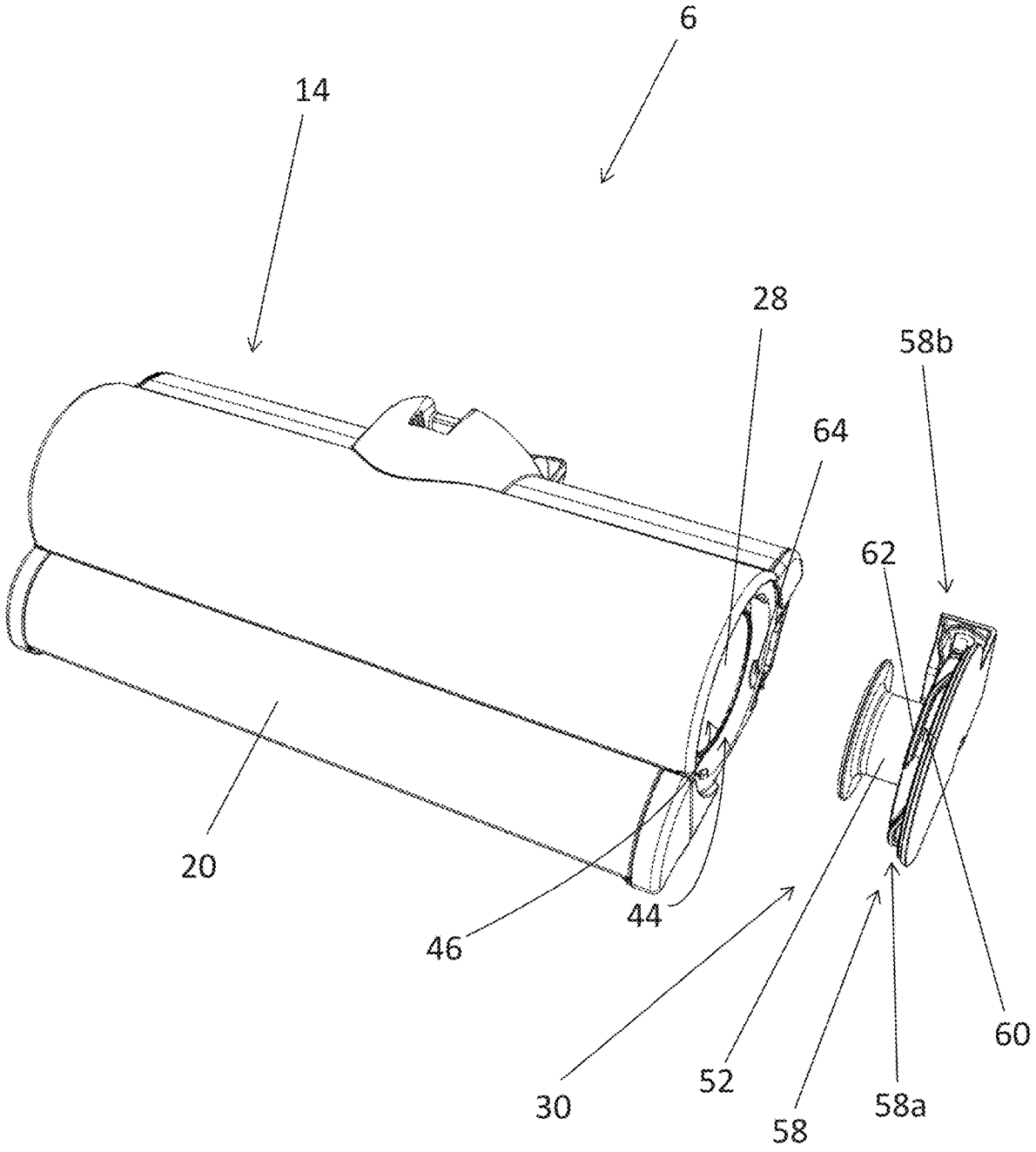
FIG. 5 is an upper front perspective view of the cleaner head, with the end cap separated from the housing.
Figure 6:
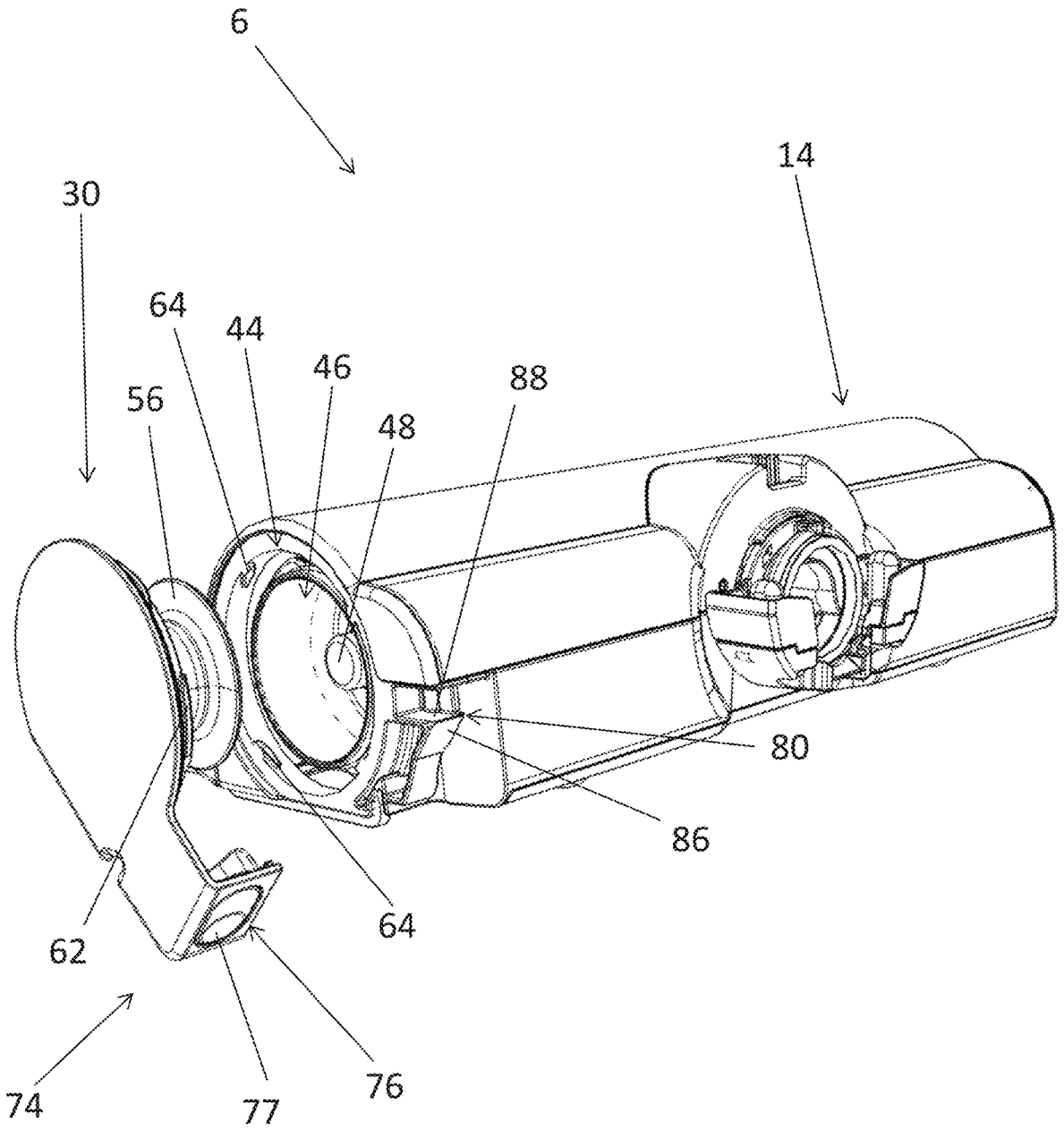
FIG. 6 is an upper rear perspective view of the cleaner head with the end cap separated from the housing.
Figure 7:
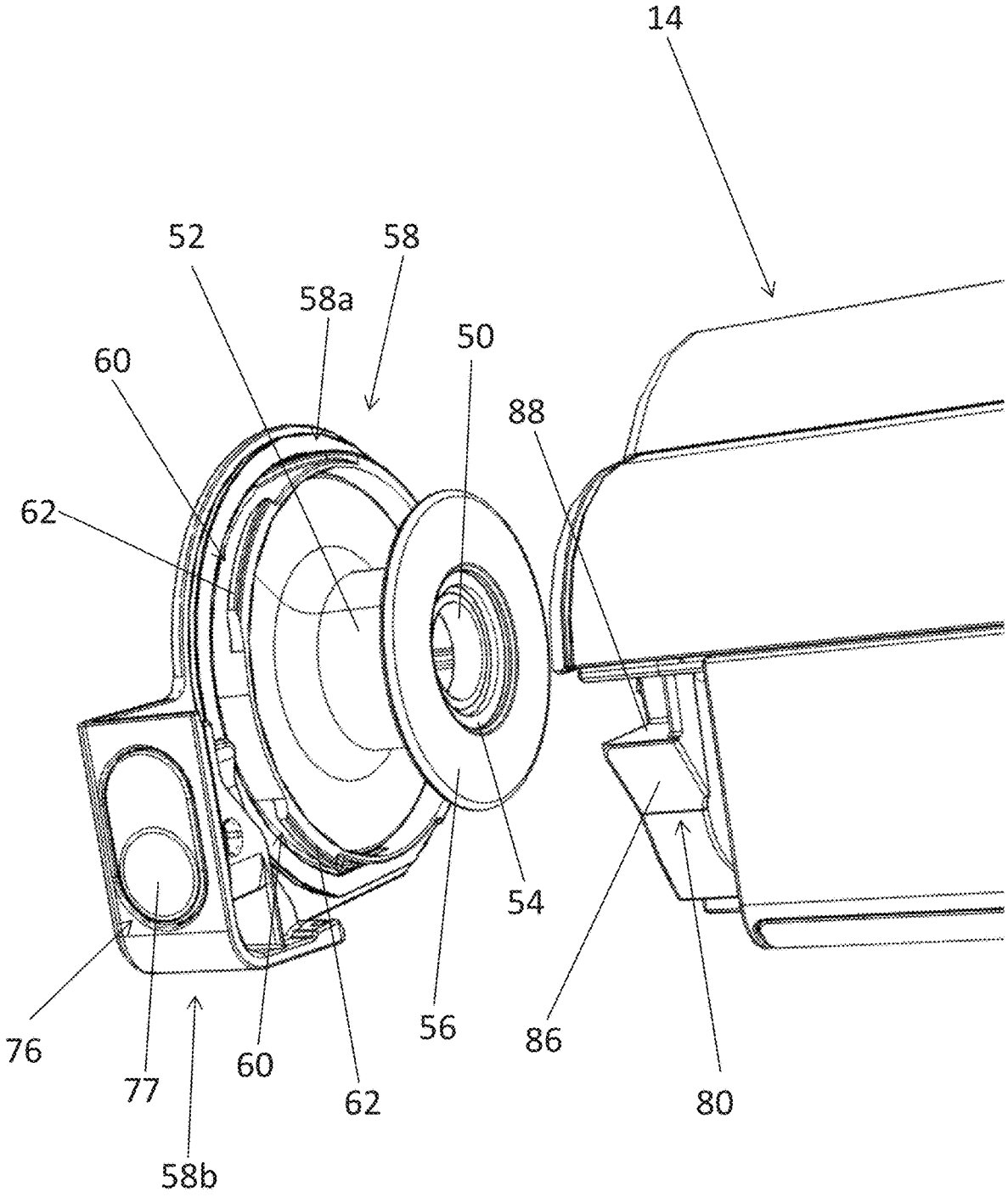
FIG. 7 is an enlarged rear perspective view of the end cap and a portion of the housing.

FIGS. 5-7 show the cleaner head 6 with the end cap 30 having been released and then separated from the housing 14. The aperture 44 in the housing 14 which is opened and closed by the end cap 30, referred to above, is visible in FIGS. 5 and 6. In this particular case the aperture 44 is fully enclosed by the housing 14, i.e. the housing runs all the way around the circumference of the aperture. In other embodiments, however, the housing may only run around a portion of the circumference of the aperture and the remaining portion of the aperture's circumference may be open. For instance, in an alternative embodiment the housing may form a crescent shape around the top and sides of the aperture but bottom portion of the aperture may be open to the floor surface upon which the cleaner head rests.

An open end portion 46 of the agitator 28 includes a stub 48 co-incident with the rotation axis 29. The end cap 30 comprises a bearing assembly 50 positioned within a support ring 52 and secured in place with a circlip 54. When the agitator 28 is positioned in the agitator chamber 26 and the end cap 30 is attached to the housing 14, the stub 48 is received inside the bearing assembly 50. The bearing assembly 50 therefore supports the corresponding end of the agitator 28. The other end of the agitator 28 is supported by another bearing assembly (not visible) positioned towards the opposite side of the cleaner head 6 (i.e. towards the side wall 22).

In this embodiment, the stub 48 of the agitator exhibits an interference fit with the bearing assembly 50 of the end cap 30. This interference fit acts attach the agitator 28 to the end cap so that a user can remove the agitator 28 from the agitator chamber 26 simply by moving the end cap 30 away from the housing 14 along the longitudinal axis of the agitator. The coupling provided by the interference fit is releasable, however, so the user can separate the agitator 28 from the end cap 30 by pulling the two components apart. The user can therefore run the agitator 30 under a tap without water getting into the bearing assembly 50, for instance, or replace a damaged agitator 28 without also having to replace the end cap 30.

Also positioned on the support ring 52 of the end cap 30 is a hair ingress flange 56. With the agitator 28 positioned in the agitator chamber 26 and the end cap 30 attached to the housing 14, the hair ingress flange 56 is received in the open end portion 46 of the brush bar. This helps to avoid hair from working its way into the bearing 50 and clogging it.

FIGS. 5-7 also show the mechanism by which the end cap 30 is attachable to and detachable from the housing 14. The end cap 30 comprises a locking portion 58 which comprises a collar 58*a* and a user operation block 58*b*. In this embodiment the locking portion 58 is rotationally fixed relative to the rest of the end cap 30. In other words, the locking portion 58 is not rotatable relative to the remainder of the end cap 30.

A circumferential array of recesses 60 is provided around the collar 58*a* of the locking portion 58, each recess being bounded by a ridge 62 projecting outwards from the collar. The aperture 44 has a complementary circumferential array of projections in the form of lugs 64. The end cap 30 can be attached to the housing 14 by rotating the end cap to the locked position, which positions each lug 64 within a corresponding recess 60. Similarly, the end cap 30 can be released from the housing 14 by rotating the end cap 30 to the unlocked position, which positions the lugs 64 outside of the recesses 60.

The interaction between the lugs of the housing 14 and the recesses 60 of the end cap 30 will now be described with reference to FIGS. 2-8E.

To attach the end cap 30 to the housing 14 to close the aperture 44, the end cap moved to the unlocked position relative to the housing 14, and is presented to the housing. This is shown in FIG. 6 and illustrated schematically in FIG. 8A. The end cap 30 is then moved towards the housing along the locking axis 42 (i.e. downwards from the perspective of FIG. 8A), so that the collar 58 is received in the opening 44 (and the stub 48 is received in the bearing assembly 50). This is shown in FIG. 4 and illustrated schematically in FIG. 9B. In this position, the recesses 60 are positioned circumferentially adjacent to their respective lugs 64.

At this point, the end cap 30 is rotated relative to the housing 14 about the locking axis 42 to the locked position. This position is shown in FIGS. 2 and 3, and illustrated schematically in FIG. 8C. In this position, the lugs 64 are positioned within their respective recesses, or in other words the ridges 62 are 'hooked' onto the lugs. At this point, the end cap 30 is attached to the housing 14. If the end cap 30 were to be urged away from the housing 14 (for instance due to the agitator 28 being knocked towards the aperture 44), the lugs 64 would brace against the sides of the recesses 60 (i.e. against the ridges 62) and resist that movement.

To detach the end cap 30 from the housing 14 from this position, the end cap 30 must be rotated in the opposite direction relative to the housing about the locking axis 42 until the end cap reaches the unlocked position. This moves the recesses 60 from around the lugs 64 (i.e. it 'unhooks' the ridges 62 from the lugs), and the end cap 30 returns to the position shown in FIG. 4 and illustrated schematically in FIG. 8B. The end cap 30 can then be pulled away from the housing 14 along the locking axis 42, removing it from the housing 4 (and in this embodiment simultaneously withdrawing the agitator 28 from the agitator chamber 26).

The end cap 30 is provided with ramp surfaces that are positioned to translate rotation of the end cap about the locking axis 42 into axial movement of the end cap along the locking axis, and to translate axial movement of the end cap along the locking axis into rotation of the end cap about the locking axis. More particularly, the end cap 30 has two different sets of ramp surfaces 66, 68, both of which provided by the ridges 62 that define the recesses 60. For clarity, ramp surfaces 66 will be referred to below as the 'first ramp surfaces', and ramp surfaces 68 will be referred to as the 'second ramp surfaces'.

Figure 8A:
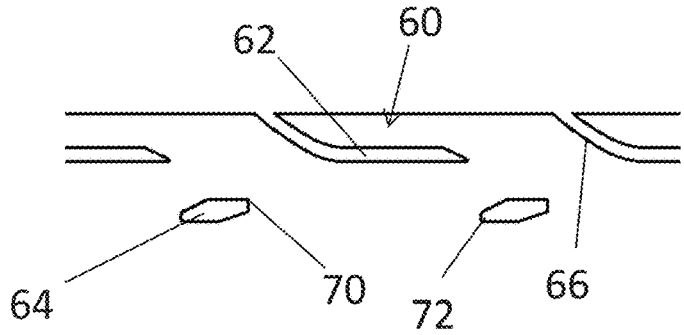
FIGS. 8A-8E are schematic representations of lugs and recesses of the housing and end cap, at different relative positions.
Figure 8B:
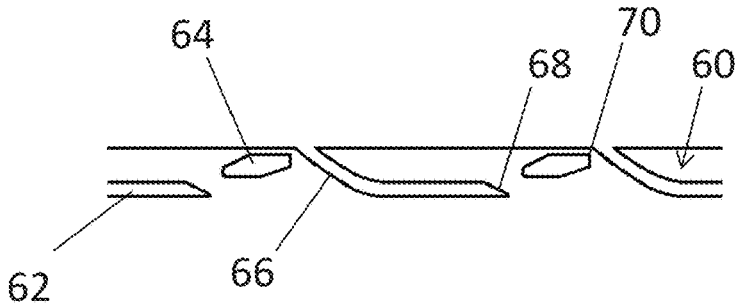
Figure 8C:
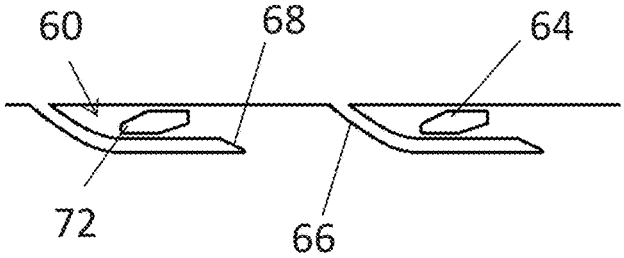
Figure 8D:
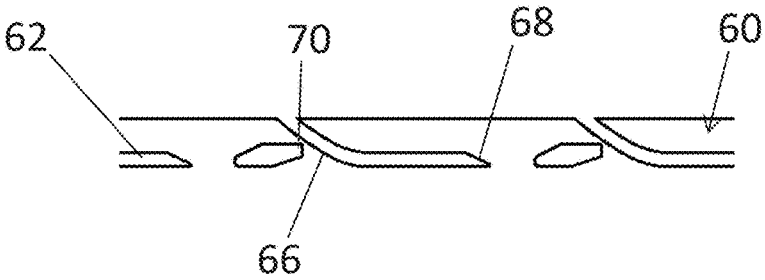

The first ramp surfaces 66 are positioned to cam the end cap 30 towards the locked position about the locking axis 42 when the end cap is urged towards the housing 14 along the locking axis. Referring to FIG. 8D in conjunction with FIGS. 2-7, if the end cap 30 is urged along the locking axis 42 towards the housing 14 in a position between the locked position and the unlocked position, each first ramp surface 66 contacts a corner 70 of a lug 64 (in this case a lug adjacent to the one which that recess 60 is configured to receive when the end cap 30 is in the locked position). This is shown in FIG. 8D. If the end cap 30 is urged further towards the housing 14 (i.e. downwards from the perspective of FIG. 8D), the first ramp surfaces 66 bear on the corners 70 of the lugs 64 and cam the end cap towards the locked position (i.e. to the right from the perspective of FIG. 8D).

This camming action means that the end cap 30 begins to rotate towards the locked position when it is pushed towards the housing 14. In other words, the end cap begins 30 to attach itself when it is pressed onto/into the housing 14. Not only can this reduce the time and effort which must be expended by a user to close the aperture 44 with the end cap 30, but it can also serve as an indication to the user of which direction the end cap 30 should be rotated in to move it to the locked position—if the user pushes the end cap 30 against the housing 14 and it begins to rotate, a user may be more likely to try to continue rotation of the end cap 30 in that direction, rather than trying to rotate the end cap 30 in the opposite direction. Furthermore, without the first ramp surfaces 66 there would be a greater chance of misalignment of the lugs 64 and recesses 60 during introduction of the end cap 30 to the housing 14 preventing the end cap from fully closing the aperture 44—if the end cap 30 is presented to the housing 14 with the lugs 64 and recesses 60 slightly misaligned, the first ramp surfaces 66 cam them into alignment.

The first ramp surfaces 66 are also positioned to cam the end cap 30 away from the housing 14 when the end cap is rotated towards the unlocked position. If the end cap 30 is in the position illustrated in FIG. 8D and the user moves it about the locking axis 42 towards the unlocked position (i.e. to the left from the perspective of FIG. 8D), the first ramp surfaces 66 bear on the corners 70 of the lugs and cam the end cap axially away from the housing (i.e. upwards from the perspective of FIG. 8D).

This camming action means that the end cap 30 can move away from the housing 14 as the end cap is unlocked. Not only can this reduce the time and effort which must be expended by a user to open the aperture 44, but it can also serve as an indication to the user of when the end cap 30 has been rotated enough for it to be removed—if the user rotates the end cap 30 and it begins to lift from the housing, he may be more inclined to try and lift the end cap further rather than continuing to rotate it. In a similar vein, it the end cap 30 beginning to lift from the housing 14 as the end cap is rotated may indicate to the user that they're rotating the end cap towards the unlocked position (i.e. they are loosening the end cap 30, rather than tightening it).

Figure 8E:
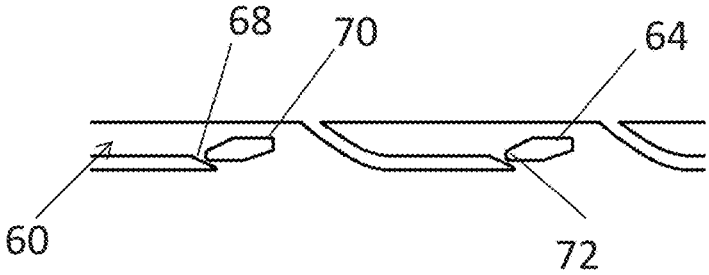

The second ramp surfaces 68 are positioned to cam the end cap 30 towards the housing 14 when the end cap 30 is rotated towards the locked position. Referring to FIG. 8E in conjunction with FIGS. 2-7, if a user rotates the end cap 30 towards the locked position with the end cap still spaced slightly from the housing 14, the second ramp surface 68 of each ridge 62 contacts a rounded portion 72 of a lug 64 (the lug that is received in the recess 60 bounded by that ridge when the end cap is in the locked position). This is shown in FIG. 8E. If the end cap 30 is rotated further towards the locked position (i.e. to the right from the perspective of FIG. 8E), the second ramp surfaces 68 bear on the rounded portions 72 of the lugs 64 and cam the end cap 30 along the locking axis 42 towards the housing 18 (i.e. downwards from the perspective of FIG. 8D).

This camming action means that the end cap 30 can be made to complete its movement towards the housing 14 as the end cap is locked. Not only can this reduce the time and effort which must be expended by a user to close the aperture 44, but it can also serve as an indication to the user of whether they are rotating the end cap 30 in the correct direction for their intended action—if the user rotates the end cap 30 and it tightens on to the housing, the user would likely realize that the direction in which they are rotating the end cap is locking the end cap rather than releasing it. The user can then continue to rotate the end cap 30 in this direction if locking the end cap is their intention, or reverse the direction of rotation if they wish to remove the end cap. Furthermore, without the second ramp surfaces 68 if the user attempted to lock the end cap 30 while it was still spaced from the housing 14 slightly, the end cap and housing would jam and fail to attach properly. The second ramp surfaces 68 therefore mean that attaching the end cap 30 requires less precision on the part of the user.

The second ramp surfaces 68 are also positioned to cam the end cap towards the unlocked position when the end cap is moved axially away from the housing 14. With the end cap in the position illustrated in FIG. 8E, if the user pulls the end cap 30 away from the housing 14 along the locking axis 42 (i.e. upwards from the perspective of FIG. 8E) the second ramp surfaces 68 bear on the rounded portions 72 of the lugs and cam the end cap 30 to rotate towards the unlocked position (i.e. to the left from the perspective of FIG. 8E).

This camming action means that the end cap 30 rotates towards the unlocked position when it is pulled away from the housing 14. In other words, the end cap 30 finishes releasing itself when it is pulled away from the housing 14. This can allow the end cap 30 to be removed from the housing 14 even if the user has not rotated the end cap all the way to the released position.

Figure 9:
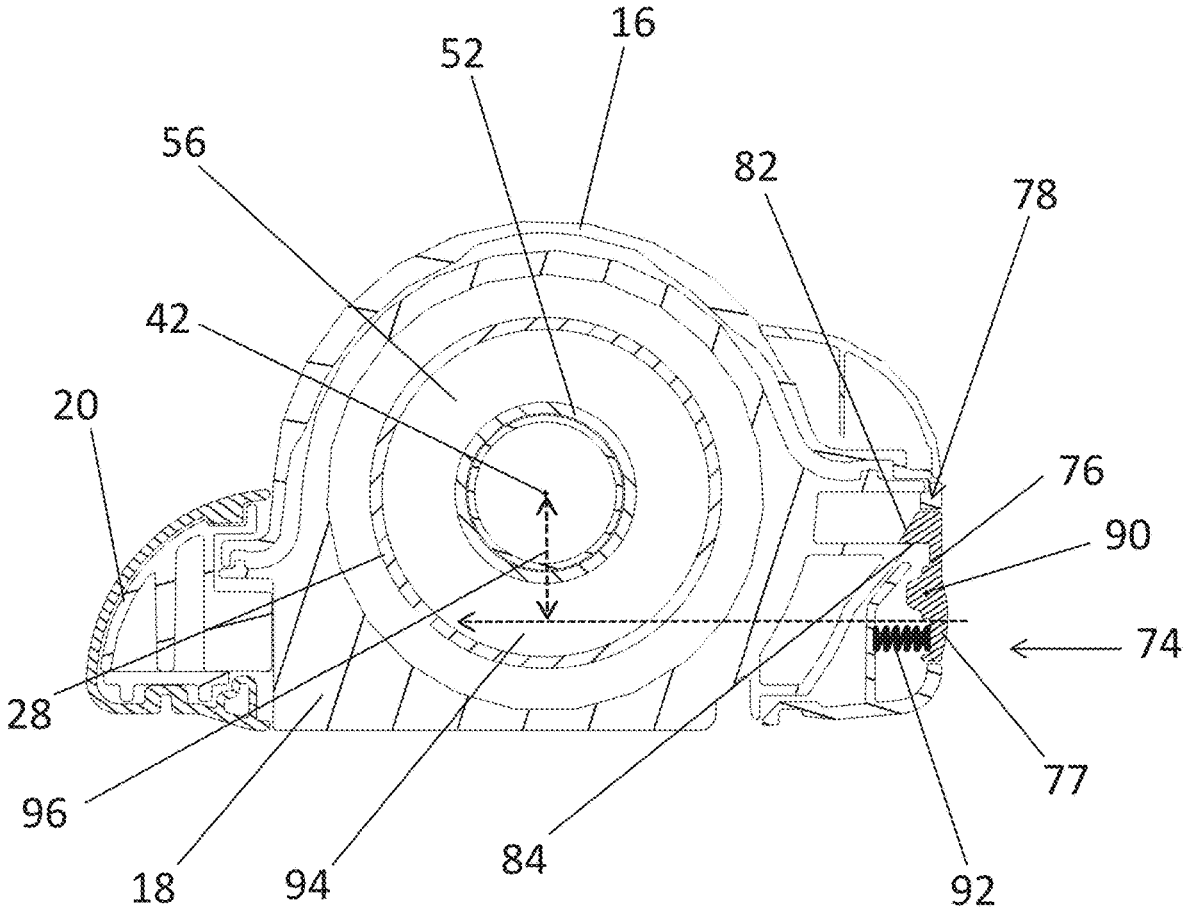
FIG. 9 is a cross-sectional side view of the cleaner head, taken in plane A of FIG. 2.

Referring now to FIGS. 6, 7 and 9, the cleaner head 6 has a latch mechanism 74 which is configured to prevent rotation of the end cap 30 to the unlocked position. More particularly, the latch mechanism 74 is arranged to hold the end cap 30 in the locked position. This reduces the risk of the end cap 30 being rotated to the unlocked position (thereby potentially opening the aperture 44 and releasing the agitator 28) unintentionally, for instance due to a knock. The latch mechanism 74 has a release member 76 which is provided on the end cap 30. The release member 76 is operable by hand to release the latch mechanism 74 and thereby allow the end cap 30 to rotate to the unlocked position when desired by the user. In this embodiment, the release member 76 is positioned on a rear surface of the cleaner head 6 when the end cap 30 is in the locked position, and has a push-button 77 positioned to be pressed by the user to operate the release member.

The latch mechanism has two complementary teeth—one tooth 78 is provided on the release member and the other tooth 80 is provided on the housing. More particularly, tooth 78 is integrally molded with the release member 76 and tooth 80 is integrally molded with the lower housing 18 of the housing 14. Tooth 78 has a cam surface 82 and an abutment surface 84, and tooth 80 has a cam surface 86 and an abutment surface 88.

In this embodiment the release member 76 takes the form of a rocker which is pivotable about a pivot axis 90 and is biased to rotate (anticlockwise from the perspective of FIG. 9) by a compression spring 92. When the end cap 30 is rotated to the locked position (i.e. anticlockwise from the perspective of FIG. 9), the cam surfaces 82, 86 of the teeth 78, 80 bear on each other and cam the teeth apart. This pivots the release member 76 about its pivot axis 90, against the bias of the spring 92 (clockwise from the perspective of FIG. 9). When the end cap 30 reaches the locked position, as shown in FIG. 9, the teeth have passed over one another and the release member 76 has pivoted back (anticlockwise from the perspective of FIG. 9) under action of the spring 92. If at this point the end cap 30 is urged to rotate towards the unlocked position, the abutment surfaces 84, 88 of the teeth 78, 80 abut and prevent this movement.

When the user presses the push-button 77, this pivots the release member 76 against the bias of the spring and lifts tooth 78 out of alignment with tooth 80. The abutment surfaces 84, 88 can therefore no longer abut, and the end cap 30 can be rotated to the unlocked position. When the user then releases the button 77, the release member 76 pivots back so that the teeth 78, 80 are re-aligned (presuming the end cap 30 has not been removed from the housing). The teeth 78, 80 are therefore ready to cam over each other during rotation of the end cap 30 to the locked position, for instance when the user wishes to re-attach the end cap.

In this embodiment, the end cap 30 is arranged such that operation of the release member 76 produces a moment which urges the end cap to rotate towards the unlocked position. When the user presses the button, at least a component of the force applied acts in a tangential direction relative to the locking axis 42. For example, if the user presses the push-button 77 by applying a force that is perpendicular to the button, the force acts in direction 94 which is spaced from the locking axis 42 by perpendicular distance 94. Operation of the release member therefore exerts a moment, the magnitude of which is equal to the magnitude of the force multiplied by the distance 96, which urges the end cap 30 to rotate towards the unlocked position (i.e. clockwise from the perspective of FIG. 9). Depending on the amount of frictional resistance that the end cap 30 experiences, this moment may be sufficient to move the end cap towards the unlocked position. Alternatively, the moment may assist with rotation of the end cap 30, but moving the end cap may require further force from the user (for instance the user may need to both press the button 77 and also twist the end cap 30).

It will be appreciated that numerous modifications to the above described embodiments may be made without departing from the scope of invention as defined in the appended claims. For instance, although in the embodiment described above the cleaner head is part of an upright vacuum cleaner, in other embodiments this may not be the case. For example, the cleaner head may be configured for use on a cylinder-type vacuum cleaner, a handheld vacuum cleaner such as a 'stick' vacuum cleaner, or another appliance such as a mopping or polishing machine. Where the cleaner head is part of a vacuum cleaner, the features of the vacuum cleaner shown in FIG. 1 should not be construed as essential. For instance, the dust separator of a vacuum cleaner according to the invention may utilize a bag or a filter instead of (or as well as) a cyclonic separating apparatus.

As another example, whilst the agitator described above is provided with bristles, this should not be construed as essential. For instance, in alternative embodiments the agitator may be provided with a felt or woven fabric surface, and/or an array of elastomeric projections, instead of or as well as bristles.

It should be noted that whilst in the above embodiment the end cap is removed from the housing by moving it axially along the locking axis, in other embodiments this may not be the case. For example, in an alternative embodiment the end cap may be removable from the housing by moving the end cap diagonally upwards and away from the housing.

It should be noted that the above description refers to the end cap being rotated between locked and unlocked positions, because the locking portion is rotationally fixed relative to the rest of the end cap. In other embodiments, however, the locking portion may be rotatable relative to the rest of the end cap, and attaching and releasing the end cap may involve rotating the locking portion relative to both the housing and the rest of the end cap.

In the above embodiment, the locking portion (more particularly the entire end cap) is rotated in one direction to move it to the locked position, and is rotated in the opposite direction to move it to the unlocked position. However, in other embodiments this may not be the case. For example, the above embodiment has closed-ended recesses (as shown in FIG. 5 and illustrated schematically in FIG. 8). Accordingly, when the end cap has been rotated to the locked position (therefore the lugs have been inserted into their respective recesses), the only way to remove the lugs from the recesses so as to move the end cap to the unlocked position would be to rotate it in the opposite direction. However, the above embodiment also has open-ended recesses, as shown in FIG. 7. If all the recesses were open ended (and there was no other obstruction such as the user interface block abutting the casing), after the end cap had been rotated to the locked position and thus the lugs inserted into their respective recesses, it would also be possible to remove the recesses from the lugs by continuing to rotate the end cap in the same direction. Each lug would then pass out of the other side of its recess, and the end cap would reach a second unlocked position. Furthermore, continued rotation of the end cap would then insert each lug into another recess (a recess adjacent to the one it was just removed from) and the end cap would reach a second locked position.

In a modification of the above described embodiment, the cleaner head may comprise a biasing member which biases the locking portion from the locked position towards the unlocked position. For instance, the part of the rear housing nearest to the tooth of the housing may have a compression spring projecting therefrom, that compression spring being positioned so that rotation of the end cap to the locked position causes the spring to be compressed between the rear housing and the user interface block. When the user released the latch mechanism, the restorative force of the spring would urge the user interface block and rear housing apart. This would urge the end cap to rotate towards the unlocked position, thereby assisting with unlocking of the end cap.

For the avoidance of doubt, the optional and/or preferred features described above may be utilized in any suitable combinations, and in particular in the combinations set out in the appended claims. Features described in relation to one aspect of the invention, may also be applied to another aspect of the invention, where appropriate.

The invention claimed is:

1. A cleaner head comprising:

an agitator;

a housing defining an agitator chamber and an aperture through which the agitator can be removed from the agitator chamber; and an end cap attachable to the housing to close the aperture, and releasable from the housing to open the aperture, wherein:

the end cap is attachable and releasable by rotating at least a portion of the end cap about a locking axis between locked and unlocked positions relative to the housing, the cleaner head has a latch configured to prevent rotation of the at least a portion of the end cap to the unlocked position, and the latch has a release which is provided on the end cap, the release being operable by hand to release the latch so as to allow the at least a portion of the end cap to rotate to the unlocked position.

2. The cleaner head of claim 1, wherein the at least a portion of the end cap is rotationally fixed on the end cap, the at least a portion of the end cap being rotatable about the locking axis by rotating the entire end cap about the locking axis.

3. The cleaner head of claim 1, wherein the end cap is arranged such that operation of the release produces a moment which urges the at least a portion of the end cap to rotate towards the unlocked position.

4. The cleaner head of claim 1, wherein the at least a portion of the end cap is movable to the locked position by rotating it about the locking axis in a first direction, and is movable to the unlocked position by rotating it about the locking axis in a second direction which is opposite to the first direction.

5. The cleaner head of claim 1, wherein the release comprises a push-button.

6. The cleaner head of claim 1, wherein:

the latch comprises a tooth provided on the at least a portion of the end cap and a complementary tooth provided on the housing, the teeth are arranged to cam over one another when the at least a portion of the end cap is rotated to the locked position, and abut to prevent rotation of the at least a portion of the end cap to the unlocked position, and operation of the release moves the teeth out of alignment so that they cannot abut one another and the at least a portion of the end cap can be rotated to the unlocked position.

7. The cleaner head of claim 6, wherein:

the release is a rocker which comprises the tooth of the at least a portion of the end cap, and the rocker is pivotable to allow the tooth of the at least a portion of the end cap to be cammed over the tooth of the housing when the at least a portion of the end cap is rotated to the locked position, and to allow the tooth of the at least a portion of the end cap to be lifted out of alignment with the tooth of the housing when the release is operated.

8. The cleaner head of claim 1, wherein the agitator chamber is configured to rotatably support the agitator.

9. The cleaner head of claim 8, wherein the end cap has a bearing assembly positioned to support an end of the agitator when the agitator is positioned within the agitator chamber.

10. The cleaner head of claim 1, wherein the end cap is attachable to the agitator such that removing the end cap from the housing also removes the agitator from the agitator chamber.

11. The cleaner head of claim 1, wherein the end cap and housing are shaped to co-operatively provide a contiguous outer surface of the cleaner head when the at least a portion of the end cap is in the locked position.

12. The cleaner head of claim 1, wherein the release is positioned on a part of the end cap which forms part of a front, rear, side or top surface of the cleaner head.

13. The cleaner head of claim 1, wherein the at least a portion of the end cap is attachable to the housing via one or more pairs of interlocking projections and recesses, the projection being received in a corresponding recess when the at least a portion of the end cap is in the locked position, and being positioned outside the corresponding recess when the at least a portion of the end cap is in the unlocked position.

14. The cleaner head of claim 1, wherein at least one of the at least a portion of the end cap and the housing comprises one or more ramp surfaces positioned to translate rotation of the at least a portion of the end cap about the locking axis into axial movement of the at least a portion of the end cap along the locking axis, or to translate axial movement of the at least a portion of the end cap along the locking axis into rotation of the at least a portion of the end cap about the locking axis.

15. The cleaner head of claim 14, wherein at least one of the ramp surfaces is positioned to cam the at least a portion of the end cap towards the locked position when the at least a portion of the end cap is urged towards the housing, or to cam the at least a portion of the end cap away from the housing when the at least a portion of the end cap is rotated towards the unlocked position.

16. The cleaner head of claim 14, wherein at least one of the ramp surfaces is positioned to cam the at least a portion of the end cap towards the housing when the at least a portion of the end cap is rotated towards the locked position, or to cam the at least a portion of the end cap towards the unlocked position when the at least a portion of the end cap is moved away from the housing.

17. The cleaner head of claim 1, wherein the at least a portion of the end cap is biased from the locked position towards the unlocked position.

18. A vacuum cleaner comprising the cleaner head of claim 1.

* * * * *